US010644424B2

(12) United States Patent
Nakazono et al.

(10) Patent No.: US 10,644,424 B2
(45) Date of Patent: May 5, 2020

(54) CONNECTOR TERMINAL, CONNECTOR INCLUDING THE CONNECTOR TERMINAL, AND METHOD FOR PRODUCING THE CONNECTOR TERMINAL

(71) Applicants: TATSUTA Electric Wire & Cable Co., Ltd., Higashiosaka-shi (JP); Iwanuma Seiko Corporation, Iwanuma-shi (JP)

(72) Inventors: Syoji Nakazono, Kizugawa (JP); Kiyotaka Urashita, Kizugawa (JP); Koji Chiba, Iwanuma (JP); Kokichi Hori, Iwanuma (JP)

(73) Assignees: TATSUTA Electric Wire & Cable Co., Ltd., Osaka (JP); Iwanuma Seiko Corporation, Miyagi (JP)

( * ) Notice: Subject to any disclaimer, the term of this patent is extended or adjusted under 35 U.S.C. 154(b) by 0 days.

(21) Appl. No.: 16/257,849

(22) Filed: Jan. 25, 2019

(65) Prior Publication Data

US 2019/0237888 A1 Aug. 1, 2019

(30) Foreign Application Priority Data

Jan. 26, 2018 (JP) ..... 2018-011883

(51) Int. Cl.

| | |
|---|---|
| ***H01R 13/11*** | (2006.01) |
| ***H01R 13/432*** | (2006.01) |
| ***H01R 43/16*** | (2006.01) |
| ***H01R 13/422*** | (2006.01) |
| ***H01R 4/18*** | (2006.01) |

(Continued)

(52) U.S. Cl.

CPC ..... *H01R 13/11* (2013.01); *H01R 4/18* (2013.01); *H01R 13/111* (2013.01);

(Continued)

(58) Field of Classification Search

CPC ..... H01R 13/11; H01R 13/642; H01R 4/18; H01R 13/4223; H01R 43/16; H01R 13/432; H01R 13/193; H01R 13/111; H01R 43/18

(Continued)

(56) References Cited

U.S. PATENT DOCUMENTS 4,002,400 A * 1/1977 Evans ..... H01R 13/111 439/748
4,776,651 A * 10/1988 Paulo ..... H01R 12/585 439/851

(Continued)

FOREIGN PATENT DOCUMENTS

JP 4996474 U 8/1974
JP 517951 U 3/1993

*Primary Examiner* — Abdullah A Riyami
*Assistant Examiner* — Nelson R. Burgos-Guntin
(74) *Attorney, Agent, or Firm* — The Webb Law Firm

(57) ABSTRACT

Provided is a connector terminal including a connection part having three or more conductive pieces arranged at intervals from each other around a central axis, wherein each of the three or more conductive pieces has a plate shape with its inside surface directed toward the central axis, wherein a distal end portion including a distal end of each conductive piece is inclined to be away from the central axis as it advances toward the distal end thereof, and wherein a surface of the distal end portion includes a distal end surface, an outside surface located opposite to the inside surface, and a connection surface that connects the distal end surface and the outside surface and that is inclined relative to the distal end surface and the outside surface. Also provided are a connector including the connector terminal, and a method for producing the connector terminal.

4 Claims, 16 Drawing Sheets

(51) Int. Cl.
*H01R 13/642* (2006.01)
*H01R 13/193* (2006.01)
*H01R 43/18* (2006.01)

(52) U.S. Cl.
CPC ..... *H01R 13/193* (2013.01); *H01R 13/4223* (2013.01); *H01R 13/432* (2013.01); *H01R 13/642* (2013.01); *H01R 43/16* (2013.01); *H01R 43/18* (2013.01)

(58) Field of Classification Search
USPC ..... 439/851
See application file for complete search history.

(56) References Cited

U.S. PATENT DOCUMENTS 5,376,012 A * 12/1994 Clark ..... H01R 13/111 439/80
5,588,852 A * 12/1996 Puerner ..... H01R 13/44 439/135
5,653,616 A * 8/1997 Hotea ..... H01R 13/113 439/851
5,857,879 A * 1/1999 Endo ..... H01R 43/16 439/843
7,931,509 B2 * 4/2011 Shaw ..... H01R 13/111 439/851
2009/0036001 A1 * 2/2009 Ishigami ..... H01R 4/184 439/816
2009/0197479 A1 * 8/2009 Glick ..... H01R 4/185 439/752
2012/0202391 A1 * 8/2012 Kobayashi ..... H01R 13/113 439/709
2016/0020528 A1 * 1/2016 Miyakawa ..... H01R 13/111 439/870
2019/0006772 A1 * 1/2019 Nakazono ..... H01R 4/188
2019/0006783 A1 * 1/2019 Nakazono ..... H01R 13/50
2019/0237888 A1 * 8/2019 Nakazono ..... H01R 4/18
2019/0237894 A1 * 8/2019 Nakazono ..... H01R 4/18

* cited by examiner

CONNECTOR TERMINAL, CONNECTOR INCLUDING THE CONNECTOR TERMINAL, AND METHOD FOR PRODUCING THE CONNECTOR TERMINAL

CROSS-REFERENCE TO RELATED APPLICATION

This application claims priority to Japanese Patent Application No. 2018-011883 filed Jan. 26, 2018, the disclosure of which is hereby incorporated by reference in its entirety.

FIELD OF THE INVENTION

The present invention relates to a connector terminal including a conductive piece extending along a direction in which a mating terminal pin is inserted and removed and being conductive with the mating terminal pin, a connector including the connector terminal, and a method for producing the connector terminal.

BACKGROUND OF THE INVENTION

Conventionally known is a connector terminal into and from which a mating terminal pin is inserted and removed (see Japanese Unexamined Utility Model Application Publication No. S49-096474). Specifically, as shown in FIG. 15, the connector terminal includes an electric connector 501 to which an electric wire 510 is connected, a lower conductive piece 502 extending from the electric connector 501, and two upper conductive pieces 503 continuously provided with a base portion of the lower conductive piece 502 and extending in the same direction as that of the lower conductive piece 502. These three conductive pieces (i.e., the lower conductive piece 502 and the upper conductive pieces 503) are arranged at intervals from each other around a central axis C5 that extends along a direction in which the mating terminal pin is inserted and removed.

In this connector terminal 500, the conductive pieces 502 and 503 respectively have leading end portions 504, including their leading ends 504*a*, that are inclined to be away from the central axis C5 as they come close to their own leading ends 504*a*. The conductive pieces 502 and 503 are formed of plate-shaped members such as metal plates having conductivity, and therefore, as shown in FIG. 16, each of the leading end portions 504 has a corner 505 forming a substantially right angle in cross section with a leading end surface 504*b* and an outward facing surface 504*c* of the leading end portion 504.

In the case where the connector terminal 500 as aforementioned is to be housed in a tubular connector housing 600 (i.e., a member shown by two short dashed lines in FIG. 16), the leading ends 504*a* of the conductive pieces 502 and 503 are likely to abut an inner surface 601 of the connector housing 600 when the connector terminal 500 is inserted into the connector housing 600, since the leading end portions 504 are inclined to be away from the central axis C5 as they come close to the leading ends 504*a* of the conductive pieces 502 and 503. The leading ends 504*a* of the conductive pieces 502 and 503 each have the corner 505 that forms a substantially right angle in cross section as aforementioned; thus, it may occur that the corner 505 is caught by the inner surface 601 to increase the insertion resistance of the connector terminal 500 being housed in the connector housing 600.

SUMMARY OF THE INVENTION

It is therefore an object of the present invention to provide a connector terminal capable of reducing the insertion resistance when being inserted into a connector housing, a connector including the connector terminal, and a method for producing the connector terminal.

The following presents a simplified summary of the invention disclosed herein in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

According to one aspect of the present invention, there is provided a connector terminal including: a connection part into and from which a mating terminal pin is inserted and removed, wherein the connection part includes a plurality of conductive pieces arranged at intervals from each other around a central axis extending along the insertion and removal direction of the mating terminal pin, wherein each of the plurality of conductive pieces has an inside surface that contacts the mating terminal pin during the insertion of the mating terminal pin into the connector terminal, and a plate shape that extends toward the removal direction of the mating terminal pin with the inside surface being directed to the central axis, wherein a distal end portion including a distal end of each of the conductive pieces is inclined to be away from the central axis as it advances toward the distal end thereof, and wherein a surface of the distal end portion includes: a distal end surface; an outside surface located opposite to the inside surface; and a connection surface connecting the distal end surface with the outside surface and inclined relative to the distal end surface and the outside surface.

According to another aspect of the present invention, there is provided a connector including: the connector terminal; and a connector housing that communicates with the outside thereof through a terminal insertion port through which the mating terminal pin can be inserted and through a proximal end opening located opposite to the terminal insertion port, and that has a terminal housing part in which the connector terminal is housed with the distal end portion of each of the plurality of conductive pieces directed to the terminal insertion port, wherein the terminal housing part has a tubular inner surface extending toward the terminal insertion port, with the connection part enclosed therein.

According to still another aspect of the present invention, there is provided a method for producing a connector terminal using a connector terminal member having a flat plate shape along a certain plane, the connector terminal member including: a tubular body elongated in a first direction that is a certain direction along the plane; and a plurality of conductive pieces that extend from the tubular body along a second direction orthogonal to the first direction and along the plane, and that are arranged at intervals from each other in the first direction, the method including: a conductive piece bending step of bending the plurality of conductive pieces so that distal end portions including distal ends of the plurality of the conductive pieces are inclined in the same direction relative to the tubular body; a chamfering step of chamfering a corner composed of a surface on one side in a thickness direction of the distal end portion of each of the plurality of conductive pieces in the connector terminal member, and a distal end surface of the distal end portion; and a tubular section forming step of, after the bending step and the chamfering step, bending the tubular body of the connector terminal member into a tubular shape with its edges in a longitudinal direction of the tubular body opposed to each other, so that the surface on the one side of each of the plurality of conductive pieces faces outward and that the distal end portion inclined in the conductive piece bending step is made to be away from a central axis of the tubular body as it advances toward an distal end of the connector terminal.

The method may be configured such that the chamfering step is performed before the conductive piece bending step, and that the chamfering step is performed to simultaneously chamfer the distal end portions of the plurality of conductive pieces so that the chamfered surfaces in the distal end portions of the plurality of conductive pieces are located on the same plane.

BRIEF DESCRIPTION OF DRAWINGS

The foregoing and other features of the present invention will become apparent from the following description and drawings of an illustrative embodiment of the invention in which.

DETAILED DESCRIPTION OF THE PREFERRED EMBODIMENT

Hereinafter, an embodiment of the present invention will be described with reference to FIG. 1 to FIG. 11.

Figure 1:
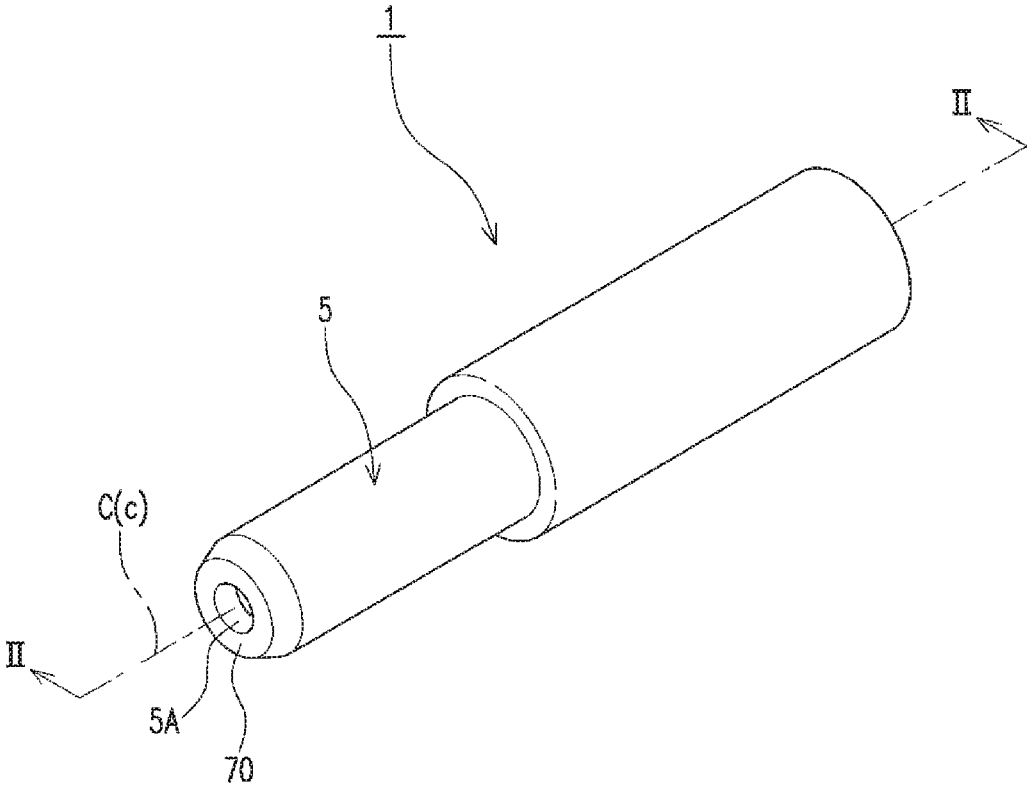
FIG. 1 is a perspective view of a connector according to an embodiment.
Figure 2:
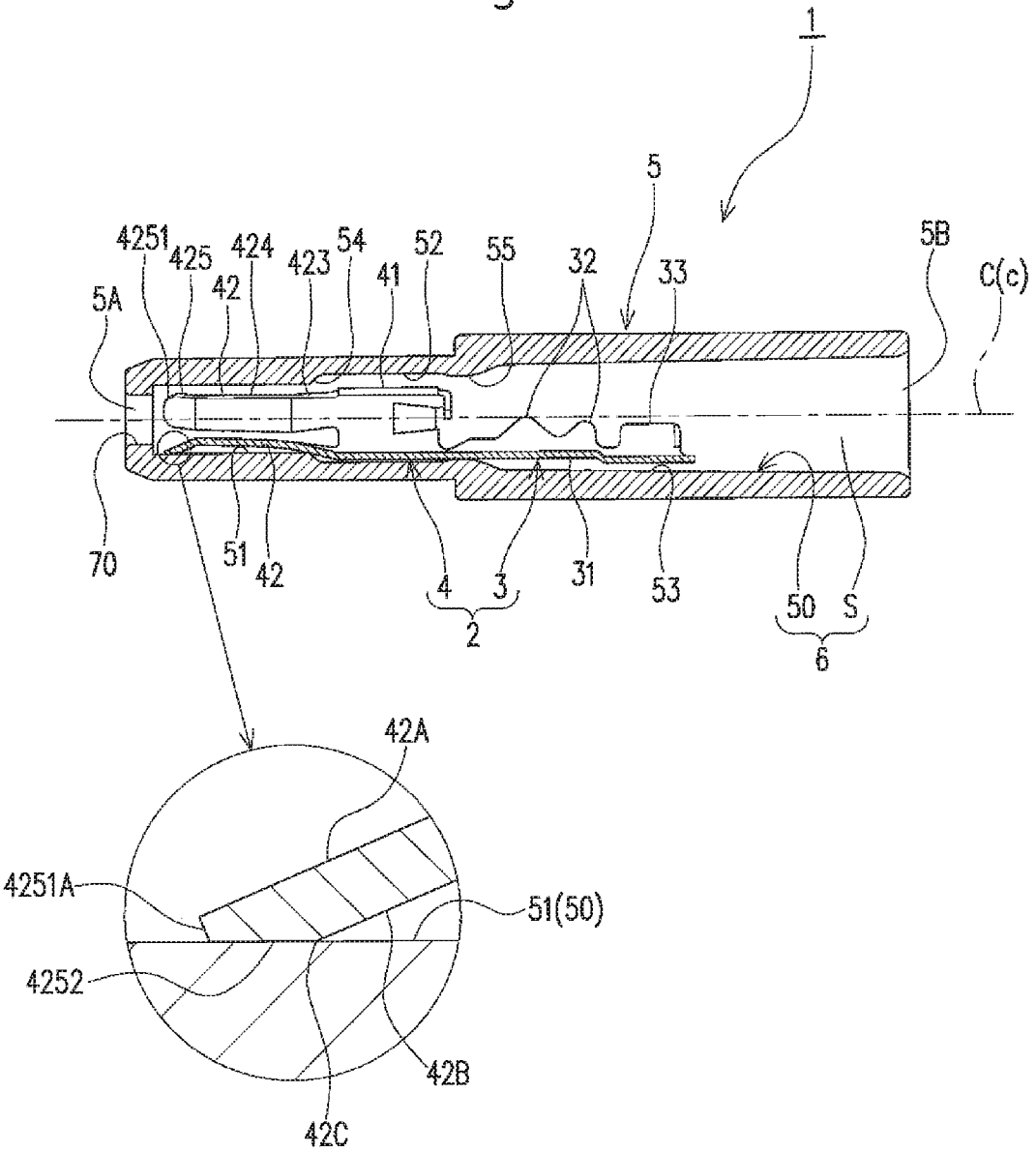
FIG. 2 is a cross sectional view and a partial enlarged view taken along line II-II in FIG. 1.

As shown in FIG. 1 and FIG. 2, a connector 1 according to this embodiment includes a connector terminal 2 to which an electric wire is connected, and a connector housing (hereinafter referred to simply as "housing") 5 in which the connector terminal 2 is housed. The connector 1 of this embodiment is a female connector to which a mating terminal pin P (see FIG. 7) such as a male connector is connected.

Figure 3:
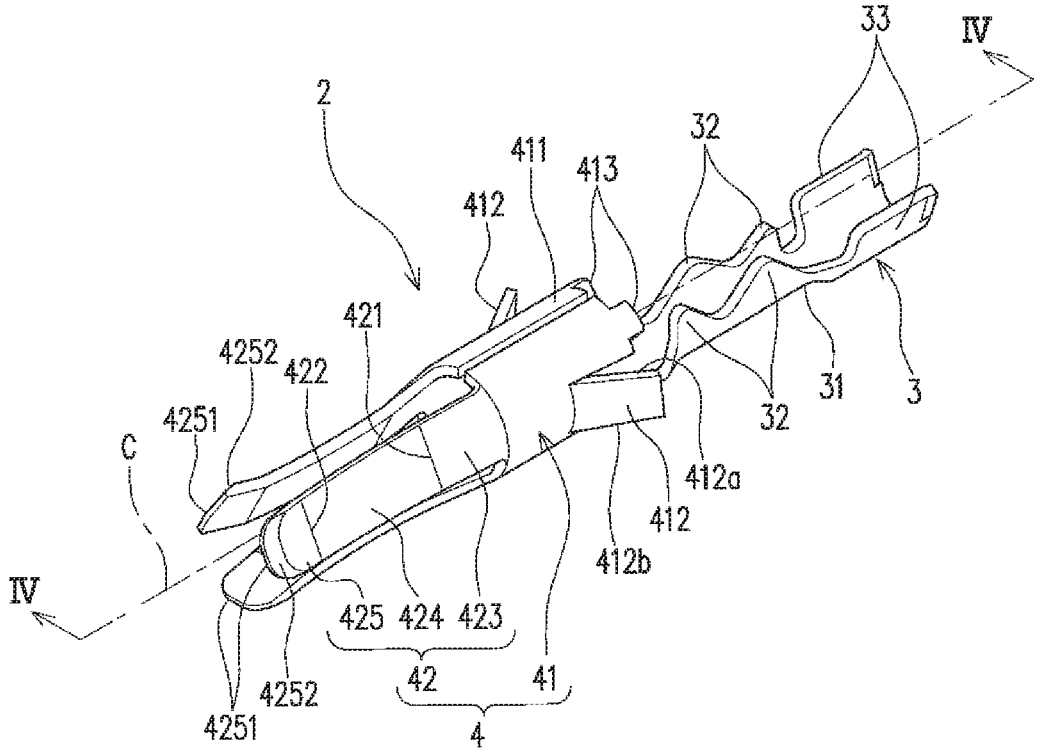
FIG. 3 is a perspective view of a connector terminal.
Figure 4:
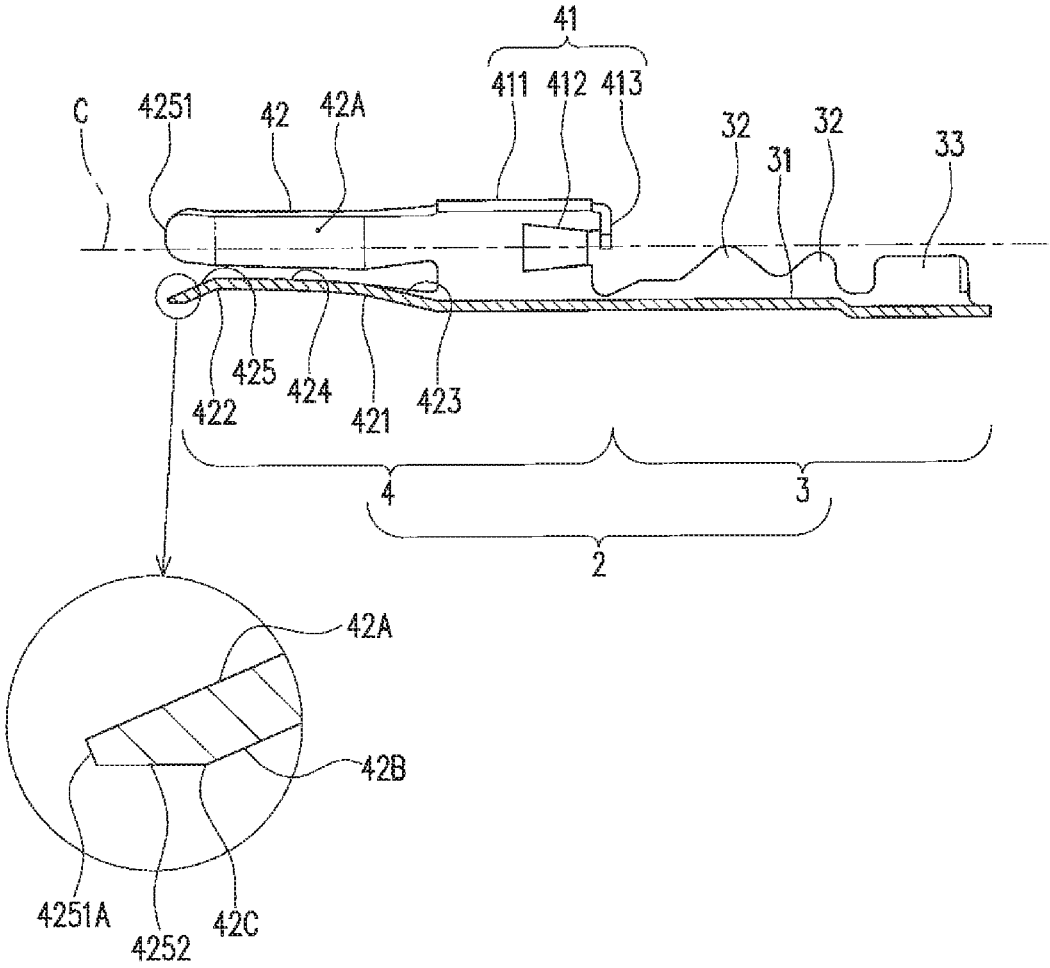
FIG. 4 is a cross sectional view and a partial enlarged view taken along line IV-IV in FIG. 3.
Figure 5:
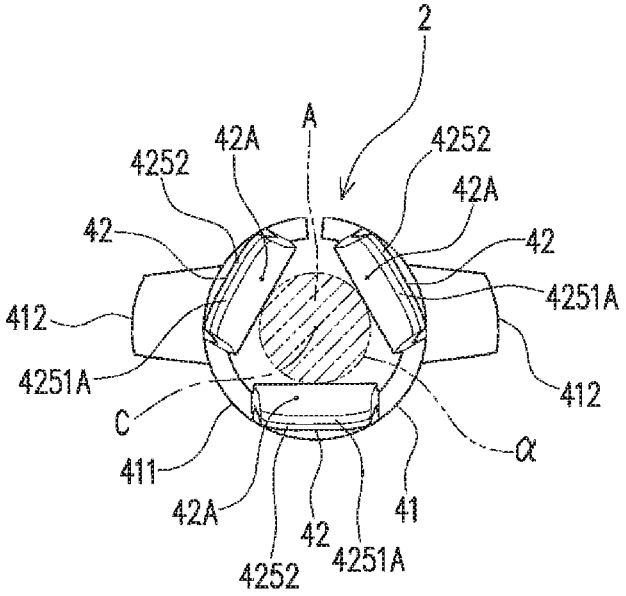
FIG. 5 is a view of the connector terminal as seen from its distal end side in a direction of a central axis of the connector terminal.

As shown in FIG. 3 to FIG. 5, the connector terminal 2 includes a connection part 4 into and from which the mating terminal pin P is inserted and removed. Specifically, the connector terminal 2 is a so-called contact terminal, and includes a terminal base 3 to which an electric wire is connectable, and the connection part 4 that is connected to the terminal base 3 and enables the mating terminal pin P to be inserted thereinto to come into conduction with the mating terminal pin P. The connector terminal 2 of this embodiment is formed of a conductive metal sheet that is stamped out into a specific shape (hereinafter referred to as a connector terminal member 2F: see FIG. 6) and then bent into a tubular shape with an axis parallel to a centerline C1 as a central axis C. The connector terminal 2 of this embodiment is formed of phosphor bronze, but may also be formed of brass, nickel silver, plated stainless steel, or the like. Hereinafter, in a direction of the central axis C, a connection part 4 side (the left side in FIG. 2) is referred to as a distal end side, and a terminal base 3 side (the right side in FIG. 2) is referred to as a proximal end side.

The terminal base 3 includes a plate-shaped base body 31 extending in the direction of the central axis C, a plurality of conductive crimping pieces 32 extending from the base body 31, and a pair of covered part crimping pieces 33 extending from a portion of the base body 31 closer to the proximal end side thereof than the conductive crimping pieces 32.

The conductive crimping pieces 32 are crimped to embrace a core wire (a conductor) exposed in a leading end portion of the electric wire so that the core wire is press-contacted to the base body 31.

The covered part crimping pieces 33 are configured to be crimped to have an insulation covered portion of the electric wire near the exposed core wire sandwiched between the base body 31 and the covered part crimping pieces 33, so that the connector terminal 2 is fixed to the electric wire.

Figure 6:
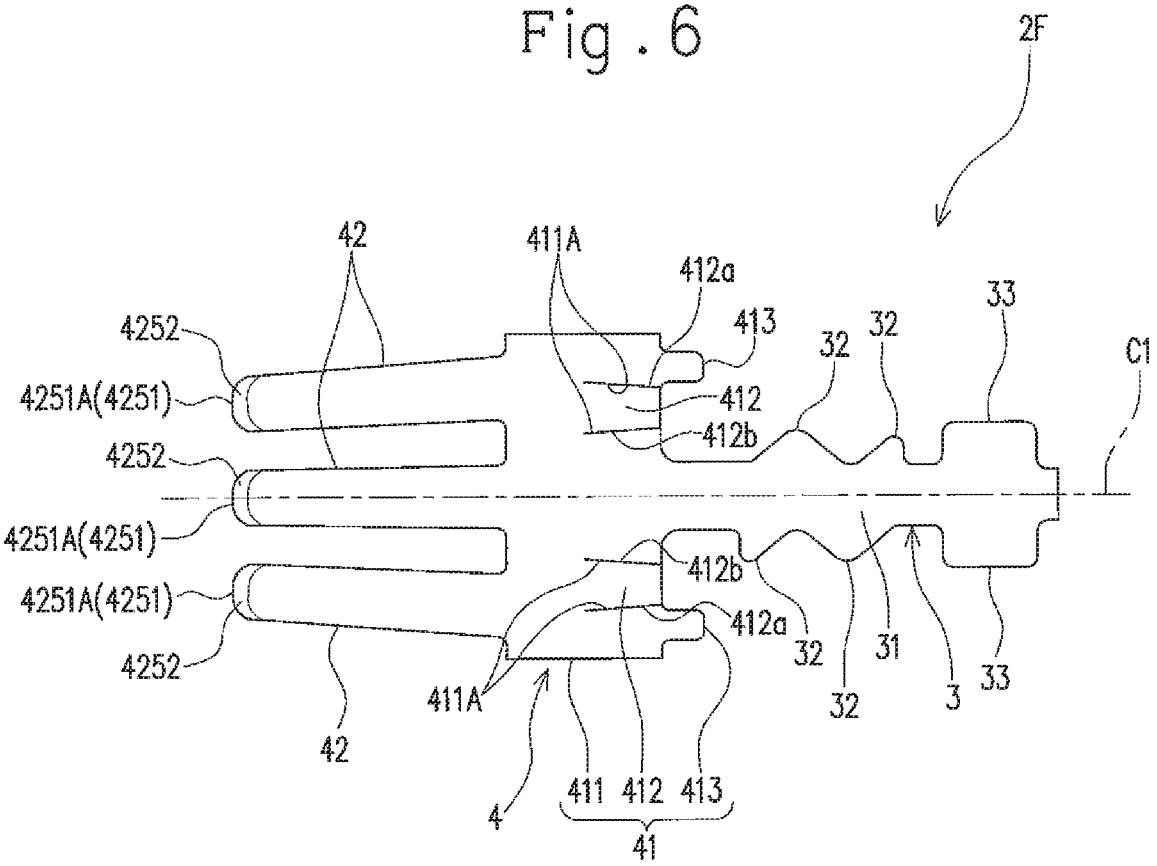
FIG. 6 is a view of a connector terminal member.

In the connector terminal member 2F (i.e., the connector terminal 2 before it is bent as aforementioned: the member shown in FIG. 6), the plurality of conductive crimping pieces 32 extend from both sides in a width direction of the base body 31 (i.e., a direction orthogonal to the centerline C1: a vertical direction in FIG. 6) toward the outside thereof in the width direction. In the connector terminal 2 of this embodiment, the conductive crimping pieces 32 on one side in the width direction (i.e., the upper side in FIG. 6) and the conductive crimping pieces 32 on the other side (i.e., the lower side in FIG. 6) alternately extend while being displaced from each other in the direction of the centerline C1 (i.e., they are alternately arranged).

In the base body 31 of the connector terminal member 2F, the pair of covered part crimping pieces 33 respectively extend toward the outside in the width direction from portions adjacent to the conductive crimping pieces 32 on the proximal end side thereof in the direction of the centerline C1. The covered part crimping piece 33 on the one side in the width direction and the covered part crimping piece 33 on the other side therein are both located at the same position with respect to the direction of the centerline C1.

The base body 31 is bent to be curved so that the terminal base 3 is formed from a part of the connector terminal member 2F that includes the base body 31, the conductive crimping pieces 32, and the covered part crimping pieces 33.

The connection part 4 includes a plurality of elastic contact pieces (conductive pieces) 42 that extend in the insertion and removal direction of the mating terminal pin P and that are arranged at intervals around the central axis C. Specifically, the connection part 4 further includes the tubular section 41 continuously provided with the base body 31, and the plurality of elastic contact pieces extend from the tubular section 41. The connection part 4 is conductively connected (fitted) to the mating terminal pin P when the mating terminal pin P is inserted into an area A (see FIG. 5) surrounded by the plurality of elastic contact pieces 42 (see FIG. 7). In this embodiment, there are three elastic contact pieces 42.

The tubular section 41 includes a tubular body (peripheral wall) 411 surrounding the central axis C (i.e., having the central axis C), and a lance 412 extending outward from the tubular body 411 to come into locking engagement with the housing 5. The tubular section 41 of this embodiment includes a pair of lances 412 provided at positions opposed to each other in the peripheral direction thereof. The tubular section 41 further includes a stopper piece 413 extending from the proximal end of the tubular body 411 toward the central axis C (see FIG. 4).

Figure 7:
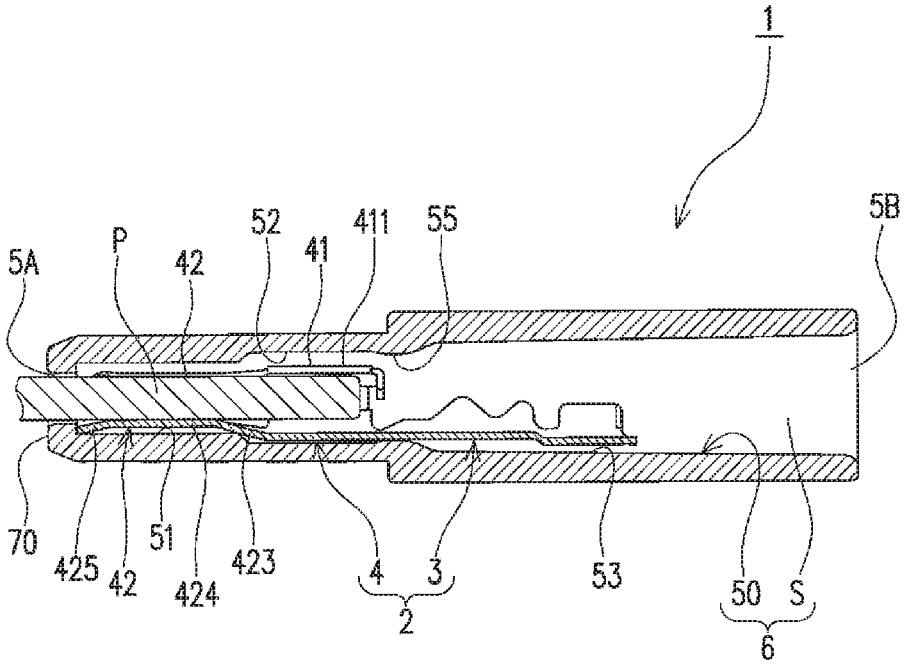
FIG. 7 is a cross sectional view showing a state where a mating terminal pin is fitted into the connector.

The tubular body 411 is a portion inside which a leading end portion of the mating terminal pin P is positioned (i.e. the area surrounded by the tubular body 411) when the mating terminal pin P is fitted to the connector 1 (see FIG. 7). The tubular body 411 of this embodiment is a rectangular plate portion of the connector terminal member 2F elongated in a direction orthogonal to the centerline C1 (see FIG. 6), and is formed with the portion being entirely curved into a tubular shape so as to make the central axis C as the center and having the edges in the longitudinal direction of the rectangular plate portion opposed to each other. The tubular body 411 of this embodiment has a circular cylindrical shape.

Each of the pair of lances 412 is configured to engage with an engagement portion (a lance engagement part 55 to be described later: see FIG. 2) provided inside the housing 5 when the connector terminal 2 is inserted through a proximal end opening 5B (see FIG. 2) into the inside of the housing 5 and moves to a specific position. This configuration allows the connector terminal 2 to be locked in the housing 5. The connector terminal 2 is consequently prevented from moving to the proximal end side inside the housing 5.

Specifically, each of the pair of lances 412 projects from the tubular body 411, and is inclined relative to the central axis C so as to be away from the central axis C as it advances toward the proximal end. The lance 412 has its leading end abutting an inner surface 50 of the housing 5. In the lance 412 of this embodiment, the pair of end edges 412*a* and 412*b* are made close to each other (i.e., the interval therebetween becomes small) as it advances from the base part of the lance 412 toward the leading end thereof (see FIG. 3 and FIG. 6).

The lance 412 as aforementioned is formed with a portion between a pair of cut lines 411A (see FIG. 6) that extend from a proximal end edge of the tubular section 411 of the connector terminal member 2F toward a distal end edge thereof and are provided at an interval from each other in a direction orthogonal to the centerline C1, the portion being raised outward.

The stopper piece 413 is configured to stop the leading end of the mating terminal pin P, when the mating terminal pin P is fitted to the connector 1, from moving further into the inside of the connector 1 (toward the proximal end of the connector 1). That is, the stopper piece 413 is configured to abut the leading end of the mating terminal pin P when the mating terminal pin P moving along the central axis C enters the tubular body 411 to thereby prevent the leading end of the mating terminal pin P from moving further into the inside of the connector 1. The stopper piece 413 is used when the connector terminal 2 is inserted into the housing 5. That is, the stopper piece 413 is pressed so that the connector terminal 2 of this embodiment is inserted (pressed) into the housing 5.

The stopper piece 413 is formed with a portion 413 extending in the direction of the centerline C1 from the proximal end edge of the tubular body 411 in the connector terminal member 2F, the portion 413 being bent toward the central axis C in the state where the tubular body 411 is in a tubular shape. In the connection part 4 of this embodiment, a plurality of (two in this embodiment) stopper pieces 413 are arranged at intervals in a circumferential direction of the tubular body 411.

The plurality of elastic contact pieces (conductive pieces) 42 extend along the central axis C, are pressed by the mating terminal pin P that is inserted through a terminal insertion port 5A (see FIG. 2) of the housing 5, and are thereby elastically deformed. Each of the elastic contact pieces 42 has an inside surface 42A that contacts the mating terminal pin P during the insertion of the mating terminal pin P into the connector terminal 2, and a plate shape that extends from the tubular section 41 (i.e., the tubular body 411) toward the removal direction of the mating terminal pin P (i.e., the left side in FIG. 2) with the inside surface 42A being directed to the central axis C (see FIG. 4 and FIG. 5). A distal end portion 425 of the elastic contact piece 42 including its distal end 4251 is inclined to be away from the central axis C as it advances from the proximal end side toward the distal end 4251. The plurality of elastic contact pieces 42 are arranged at intervals from each other on the circumference of a circle with the central axis C as the center. A specific configuration of each of the elastic contact pieces 42 is described as follows.

The elastic contact pieces 42 are elastically-deformable plate-shaped portions that extend from the tubular section 41, and are arranged at equal intervals around the central axis C, with their inside surfaces (i.e., surfaces orthogonal to a thickness direction thereof) 42A (see FIG. 4 and FIG. 5) directed to the central axis C. Each of the elastic contact pieces 42 has two bent portions (i.e., a first bent portion 421 and a second bent portion 422) arranged at an interval from each other in the direction of the central axis C (see FIG. 3, FIG. 4, and FIG. 8). Hereinafter, a portion of the elastic contact piece 42 more on the proximal end side than the first bent portion 421 is referred to as a proximal end portion 423, a portion thereof between the first bent portion 421 and the second bent portion 422 is referred to as a contact portion 424, and a portion thereof more on the distal end side than the second bent portion 422 is referred to as a distal end portion 425.

The proximal end portion 423 extends from the contact portion 424 toward the terminal base 3, and is directly or indirectly connected to the terminal base 3. The proximal end portion 423 of this embodiment is connected to the terminal base 3 through the tubular section 41. That is, the proximal end portion 423 connects the contact portion 424 with the tubular section 41 (specifically, the tubular body 411). The proximal end portion 423 is inclined with respect to the central axis C so as to be away from the central axis C as it advances from the contact portion 424 toward the proximal end (see FIG. 2, FIG. 4, and FIG. 8).

Figure 8:
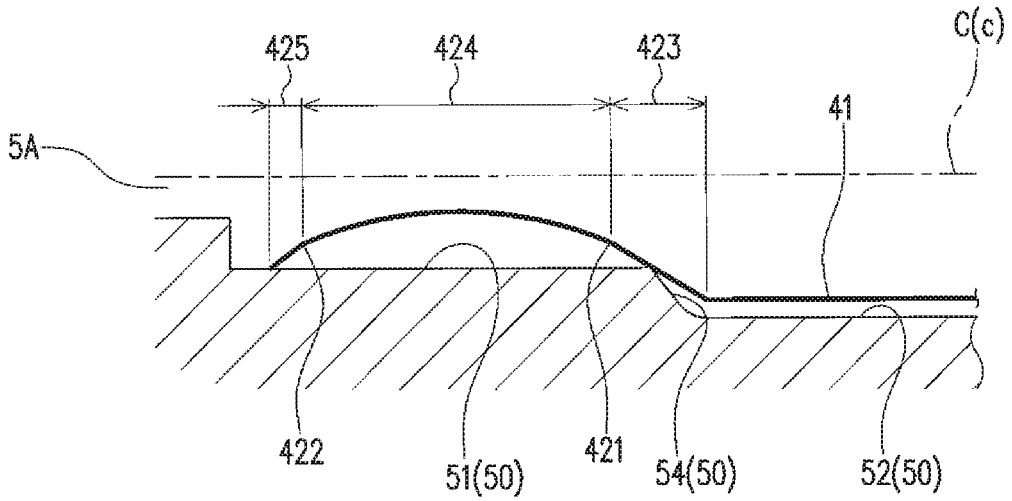
FIG. 8 is a schematic explanatory view for an elastic contact piece.
Figure 9:
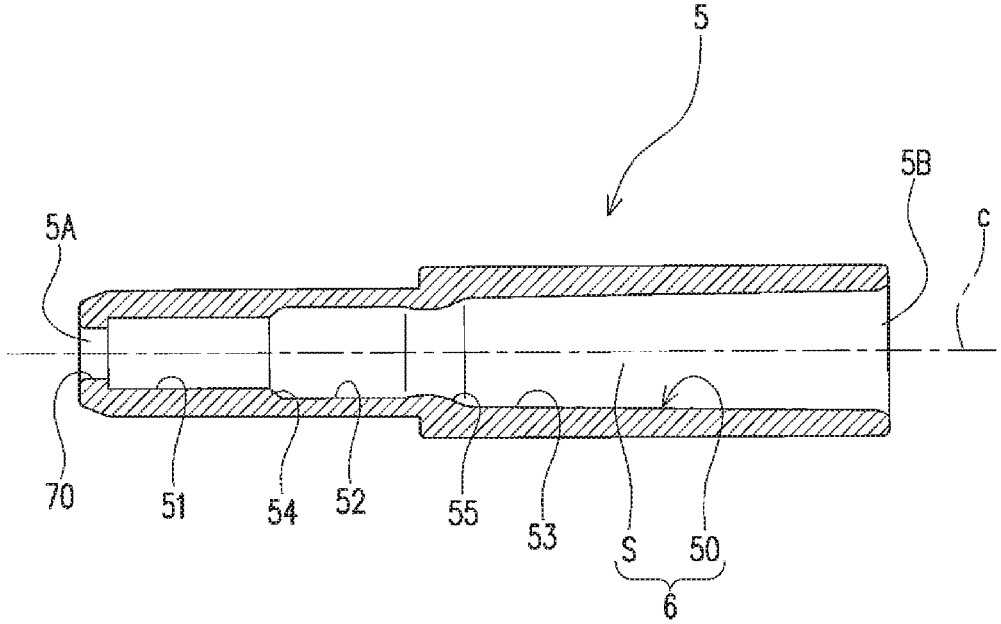
FIG. 9 is a cross sectional view of a connector housing used for the connector.

The contact portion 424 is a portion that is in contact (conduction) with the mating terminal pin P when the mating terminal pin P is inserted through the terminal insertion port 5A. The contact portion 424 is deflectable. Specifically, the contact portion 424 extends along the central axis C and is curved in such a direction as to bulge toward the central axis C (see FIG. 8). With this curving, an inscribed circle a (see FIG. 5) that is centered at the central axis C and tangent to a portion of each of the contact portions 424 closest to the central axis C is made smaller than the outer circumference of the mating terminal pin P. This configuration causes the contact portions 424 to be pressed in a direction away from the central axis C by the mating terminal pin P that is inserted into the area A surrounded by the elastic contact pieces 42, and to be thereby elastically deformed (from a curved form to a flat form). The contact portion 424 of this embodiment is provided so that its proximal end is closer to the central axis C than its distal end. Note that the actual curving (deflection) of the contact portion 424 is so small that the schematic view in FIG. 8 shows the exaggerated curving (deflection) of the contact portion 424.

The distal end portion 425 extends from a distal end of the contact portion 424 (the edge on the opposite side to the proximal end portion 423) and is positioned outward of the contact portion 424 in a direction orthogonal to the central axis C. Specifically, the distal end portion 425 is inclined with respect to the central axis C so as to be away from the central axis C as it advances from the contact portion 424 toward the distal end (see FIG. 2, FIG. 4, and FIG. 8).

The distal end edge (profile) of the distal end portion 425 of this embodiment has a curved (rounded) shape. The curvature, the curvature radius, and the like of this curved shape are set on the basis of the shape of the inner surface 50 of the housing 5 (i.e., a cross sectional shape orthogonal to a central axis c).

The surface of the distal end portion 425 includes a distal end surface 4251A of the elastic contact piece 42 (distal end portion 425), an outside surface 42B located opposite to the inside surface 42A of the elastic contact piece 42 (specifically, an area in the outside surface 42B corresponding to the distal end portion 425), and a connection surface (chamfered surface) 4252 connecting the distal end surface 4251A with the outside surface 42B and inclined with respect to the distal end surface 4251A and the outside surface 42B, i.e., the connection surface extending at an angle with respect to the distal end surface 4251A and the outside surface 42B (see FIG. 2, FIG. 4, and FIG. 5). The connection surface 4252 of this embodiment is formed by chamfering the corner between the distal end surface 4251A and the outside surface 42B so as to leave a part of the distal end surface 4251A, and is provided at least in an area in the distal end portion 425 configured to abut the inner surface 50 of the housing 5. The connection surface 4252 of this embodiment is a chamfered surface so that its cross section is parallel or substantially parallel to the central axis C in the state where the connector terminal 2 is not housed in the housing 5 (see FIG. 4).

The distal end portion 425 is configured to have its end on the distal end 4251 side moving toward the distal end while being in contact with an inner surface 50 of the housing 5 (specifically, a first portion 51), that is, sliding toward the distal end with respect to the inner surface 50 of the housing 5, as the mating terminal pin P is inserted through the terminal insertion port 5A of the connector housing 5 to elastically deform the contact portion 424 (see FIG. 2 and FIG. 7). The portion of the elastic contact piece 42 that is in sliding contact with the inner surface 50 at the time of the sliding is the connection surface 4252 or the boundary portion between the connection surface 4252 and the outside surface 42B (i.e., a corner 42C forming an obtuse angle in cross section).

The connector terminal 2 configured as above is housed in the housing 5 with the connection part 4 directed to the terminal insertion port 5A (see FIG. 2).

As shown in FIG. 1, FIG. 2, and FIG. 7 to FIG. 9, the housing 5 includes a terminal housing part 6 that communicates with the outside through the terminal insertion port 5A and the proximal end opening 5B opposite to the terminal insertion port 5A, and that houses the connecter terminal 2 therein with the distal end portion 425 of each elastic contact piece 42 directed toward the terminal insertion port 5A. The terminal housing part 6 has the tubular inner surface 50 extending toward the terminal insertion port 5A, with the connection part 4 enclosed therein. A more specific description is provided below.

The housing 5 of this embodiment has a tubular shape having the central axis c, and is formed of an insulating resin. The housing 5 has the inner surface 50, and the inner surface 50 defines a space (a housing space) S in which the connector terminal 2 is housed. The terminal housing part 6 of this embodiment has the inner surface 50 and the housing space S. The terminal insertion port 5A is configured to communicate the housing space S with the outside in the direction of the central axis c at the distal end of the housing 5, and the proximal end opening 5B is configured to communicate the housing space S with the outside in the direction of the central axis c at the proximal end of the housing 5.

The inner surface 50 of this embodiment defines a circular or substantially circular cross section at every position in the direction of the central axis c (cross section in a surface direction orthogonal to the central axis c of the inner surface 50). The inner surface 50 defines a plurality of portions having different diameters. Specifically, the inner surface 50 has, in order from the distal end side to the proximal end side, the first portion 51 having a smallest diameter, a second portion 52 having a greater diameter than the first portion 51, and a third portion 53 having a greater diameter than the second portion 52.

The first portion 51 encloses the plurality of elastic contact pieces 42 through the inner surface 50, the second portion 52 encloses the tubular section 41 through the inner surface 50, and the third portion 53 encloses the terminal base 3 through the inner surface 50. The first portion 51 and the second portion 52 are connected to each other through a reduced diameter portion 54 that has a diameter reduced as it advances toward the distal end. The second portion 52 and the third portion 53 are connected to each other through a lance engagement part 55. The portions 51 to 55 that are defined by the inner surface 50 share the same central axis. In the inner surface 50 of this embodiment, the boundary portion (i.e., the corner) between the first portion 51 and the reduced diameter portion 54 abuts the proximal end portions 423 of the elastic contact pieces 42 of the connector terminal 2.

The lance engagement part 55 is arranged at a position corresponding to the lances 412 of the connection part 4 (specifically, the tubular body 411). The lance engagement part 55 is defined by partial reduction of the diameter of the inner surface 50, which is provided in the direction of the central axis c (a portion projecting toward the central axis c). Specifically, the lance engagement part 55 reduces its diameter to a diameter smaller than that of the second portion 52 as it advances from the end of the third portion 53 toward the distal end, and then increases its diameter as it advances further toward the distal end.

The proximal end portion of the third portion 53 defines the proximal end opening 5B that is formed in the proximal end portion of the housing 5. The housing space S of the housing 5 and the external space communicate with each other through the proximal end opening 5B.

The housing 5 has a wall (distal end wall) 70 that defines the terminal insertion port 5A at the distal end of the housing 5. The housing space S of the housing 5 and the external space communicate with each other also through the terminal insertion port 5A.

The connector 1 as above is fabricated with the connector terminal 2, which is produced as described below, being housed in the terminal housing part 6 of the housing 5.

A plate-shaped member having conductivity is, for example, punched out to form the connector terminal member 2F. Subsequently, a chamfering step is carried out for forming the connection surfaces 4252 at the distal end portions of the elastic contact pieces 42 of the connector terminal member 2F.

Figure 10:
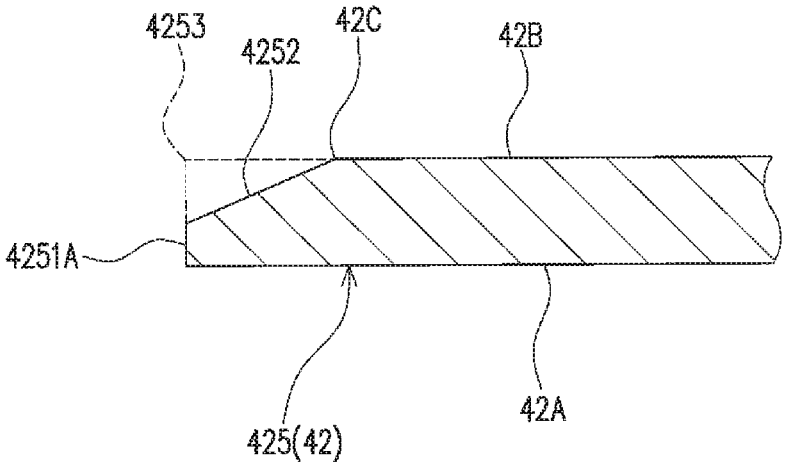
FIG. 10 is an explanatory view for chamfering of a distal end corner of the elastic contact piece.

As shown in FIG. 10, in the chamfering step, the distal end portion 425 of each of the elastic contact pieces 42 of the connector terminal member 2F is chamfered or beveled to have a corner 4253 composed of a surface on one side in the thickness direction (i.e., the outside surface of the elastic contact piece 42 of the connector terminal 2) 42B and the distal end surface 4251A of the distal end portion 425. In this chamfering step, the corner 4253 is beveled so as not to eliminate the distal end surface 4251A.

In the chamfering step of this embodiment, the distal end portions 425 of the elastic contact pieces 42 are chamfered at the same timing (i.e., simultaneously) so that the chamfered surfaces (connection surfaces) 4252 of the distal end portions 425 of the elastic contact pieces 42 are located on the same plane (i.e., so that the connection surfaces (chamfered surfaces) 4252 are completely overlapped with one another, when the connector terminal member 2F is seen from a direction in which the elastic contact pieces 42 are aligned).

Figure 11:
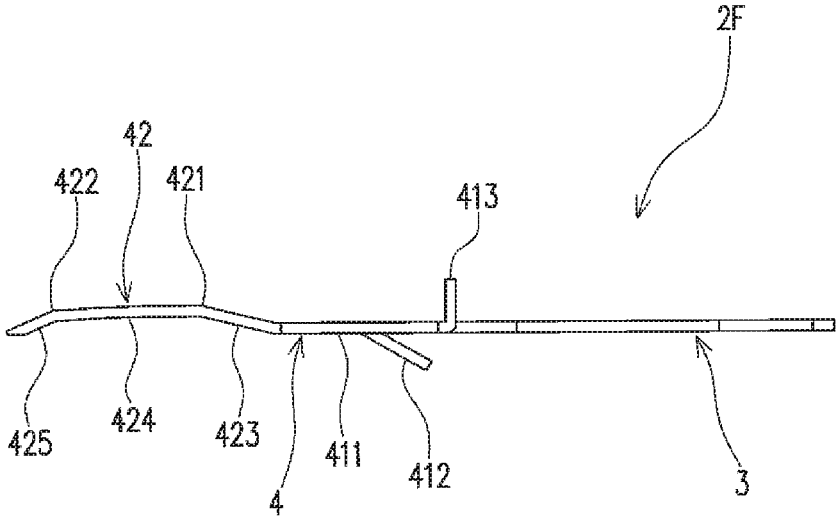
FIG. 11 is a view of the connector terminal member after a bending step of the elastic contact piece, as seen from a direction in which the elastic contact pieces are aligned.

Next, a bending step is carried out to bend the elastic contact pieces 42. That is, in the method for producing the connector terminal 2 of this embodiment, the chamfering step is followed by the bending step to bend the elastic contact pieces (conductive pieces). In this bending step, as shown in FIG. 11, the elastic contact pieces 42 are bent so that the distal end portions 425 of the elastic contact pieces 42 of the connector terminal member 2F are inclined in the same direction relative to the tubular body 411. Specifically, in the bending step, each of the elastic contact pieces 42 in a straight shape is bent to form two bent portions (i.e., the first bent portion 421 and the second bent portion 422), and the contact portion 424 is curved to bulge on the inside surface 42A side (i.e., to bulge toward the central axis C when the connector terminal 2 is formed). At this time, a portion between each pair of cut lines 411A (see FIG. 6) provided in the tubular body 411 of the connector terminal member 2F is raised (bent) to be inclined relative to the tubular body 411 to further form each of the lances 412. Further, a portion of the tubular body 411 of the connector terminal member 2F extending in the direction of the centerline C1 from the proximal end edge (i.e., a portion corresponding to one of the stopper pieces 413 in the connector terminal 2) is bent to form each of the stopper pieces 413.

After the bending (the bending step) is applied to the elastic contact pieces 42, the lances 412, the stopper pieces 413, and the like, the base body 31 is bent to be curved so that the portion of the connector terminal member 2F in which the base body 31, the conductive crimping pieces 32, and the covered part crimping pieces 33 are formed is formed into the terminal base 3. The tubular body 411 of the connector terminal member 2F is entirely curved into a circular cylindrical shape around the central axis C to have its edges in the longitudinal direction opposed to each other, so that the tubular section 41 is formed.

The connector terminal 2 is thus complete, and is housed in the housing 5 to form the connector 1.

Specifically, the connector terminal 2 is housed in the terminal housing part 6 by inserting the distal ends 4251 side of the elastic contact pieces 42 through the proximal end opening 5B. When the connector terminal 2 is inserted in the housing 5, the distal end portion 425 of each of the elastic contact pieces 42 is in sliding contact with the inner surface 50 of the housing 5 (for example, the first portion 51 and the lance engagement part 55). Specifically, the connection surface 4252 parallel or substantially parallel to the insertion direction (i.e., the direction in which the central axis C extends) or the boundary portion (i.e., the corner forming an obtuse angle in cross section) 42C between the connection surface 4252 and the outside surface 42B is in sliding contact with the inner surface 50 of the housing 5. Thus, the connector terminal 2 configured as above can reduce the insertion resistance as compared with the case where a corner of a non-chamfered distal end of an elastic contact piece (i.e., a corner forming a right angle or a substantially right angle in cross section) is in sliding contact. Further, the connector terminal 2 is less likely to damage the inner surface 50.

According to the connector terminal 2 of this embodiment, the distal end portion 4251 of the elastic contact piece 42 is inclined in such a direction as to flare or spread outward as it advances toward the distal end 4251 (i.e., inclined in a direction away from the central axis C as it advances toward the distal end 4251). Thus, the connector terminal 2 when inserted into the terminal housing part 6 of the housing 5 is likely to abut the tubular inner surface 50 that defines the terminal housing part 6. However, since the outside corner 4253 (see FIG. 10) at the distal end 4251 of the elastic contact piece 42 is chamfered (i.e., the connection surface 4252 between the distal end surface 4251A and the outside surface 42B in the surface of the distal end portion 425 is inclined with respect to the distal end surface 4251A and the outside surface 42B), the distal end 4251 of the elastic contact piece 42, even if it abuts the inner surface 50 of the housing 5, is less likely to be caught by the inner surface 50 when the connector terminal 2 is inserted into the housing 5. Thus, the connector terminal 2 of this embodiment can effectively reduce the insertion resistance when inserted into the housing 5.

In the connector 1 of this embodiment, the distal end 4251 of the elastic contact piece 42 has the chamfered outside corner 4253. Thus, damage to the inner surface 50 of the housing 5 is suppressed when the distal end 4251 of the elastic contact piece 42 is in sliding contact with the inner surface 50 in the insertion and removal direction at the time of the insertion and removal of the mating terminal pin P.

The distal end 4251 of the elastic contact piece 42 with the chamfered outside corner 4253 can also suppress itself from being caught by the inner surface 50 of the housing 5 when in sliding contact with the inner surface 50 in the insertion and removal direction of the mating terminal pin P. Thus, the resistance of the mating terminal pin P being inserted and removed can be prevented from being excessively large due to the catching.

In the method for producing the connector terminal 2 of this embodiment, the chamfering step is performed before the bending step to bend the elastic contact pieces, and in the chamfering step, the distal end portions 425 of the elastic contact pieces 42 are chamfered at the same timing so that the chamfered surfaces (connection surfaces) 4252 at the distal end portions 425 of the elastic contact pieces 42 are located on the same plane. Thus, it is possible to make the chamfering step easier than the case where each elastic contact piece 42 is separately chamfered, where the amount of chamfering is changed for each individual elastic contact piece 42, or where the chamfering angle is changed for each individual elastic contact piece 42, because chamfering is made at the same timing for the corners 4253 (see FIG. 10) of the distal ends 4251 of the plurality of elastic contact pieces 42 before being bent and inclined in the connector terminal member 2F to thereby enable the chamfered surfaces 4252 of the elastic contact pieces 42 to be located on the same plane.

It is a matter of course that the connector terminal, the connector, and the method for producing the connector terminal, of the present invention are not limited to the aforementioned embodiment, but various modifications can be made without departing from the gist of the present invention. For example, a configuration of an embodiment may be added to a configuration of another embodiment, and part of a configuration of an embodiment may be replaced by a configuration of another embodiment. Further, part of a configuration of an embodiment may be deleted.

Figure 12:
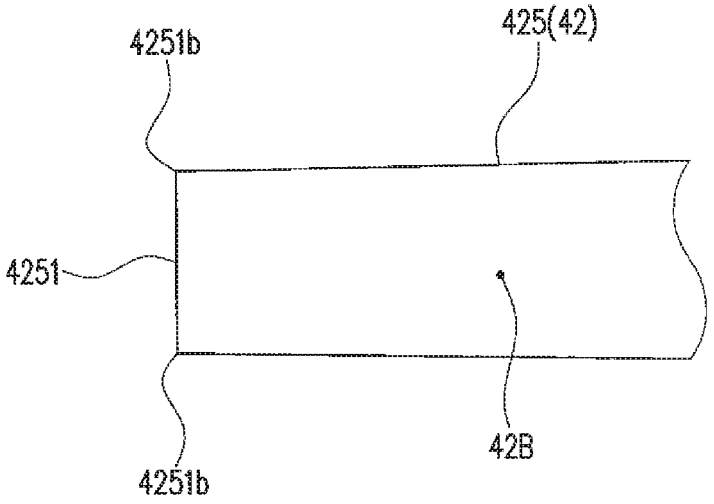
FIG. 12 is an enlarged view showing the shape of a distal end portion of an elastic contact piece according to another embodiment.
Figure 13:
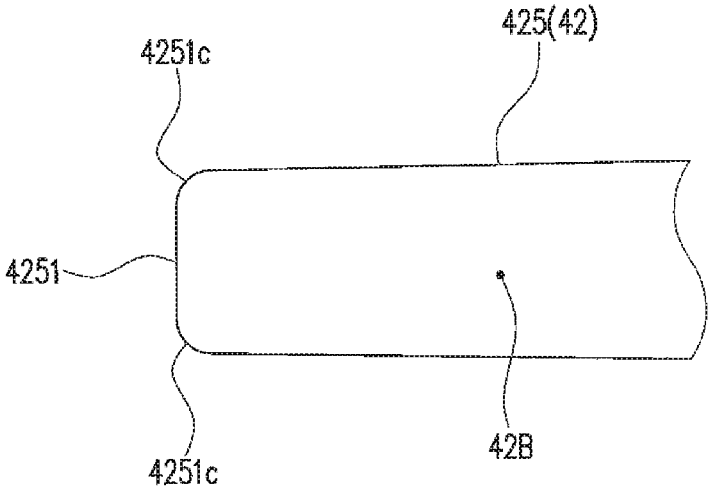
FIG. 13 is an enlarged view showing the shape of a distal end portion of an elastic contact piece according to another embodiment.

The aforementioned embodiment has been described by taking, for example, the case where the distal end 4251 of the elastic contact piece 42 has a curved shape (i.e., a rounded shape), without limitation thereto. For example, the distal end 4251 of the elastic contact piece 42 can be, as shown in FIG. 12, in a shape having two right-angled corners 4251*b* as seen from the normal direction of the outside surface 42B, or, as shown in FIG. 13, in a shape having two rounded corners 4251*c*, that is, a shape having a straight portion between the two rounded corners 4251*c*. Even if the distal end 4251 of the elastic contact piece 42 is formed into such a shape, the connector terminal 2 can still reduce its insertion resistance when the connector terminal 2 is inserted into the housing 5 as long as the distal end 4251 of the elastic contact piece 42 has the connection surface 4252. The distal end 4251 of the elastic contact piece 42 having such a shape can also reduce damage to the inside of the housing 5 resulting from the sliding contact of the distal end 4251 with the inner surface 50 through the elastic deformation of the elastic contact piece 42 inside the housing 5 caused by the insertion and removal of the mating terminal pin P.

Figure 14:
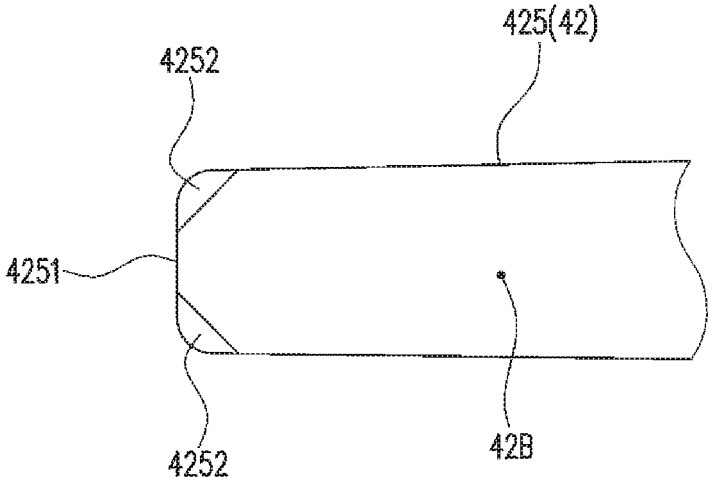
FIG. 14 is an enlarged view of a distal end portion of an elastic contact piece according to another embodiment, showing a range of a connection surface of the elastic contact piece.
Figure 15:
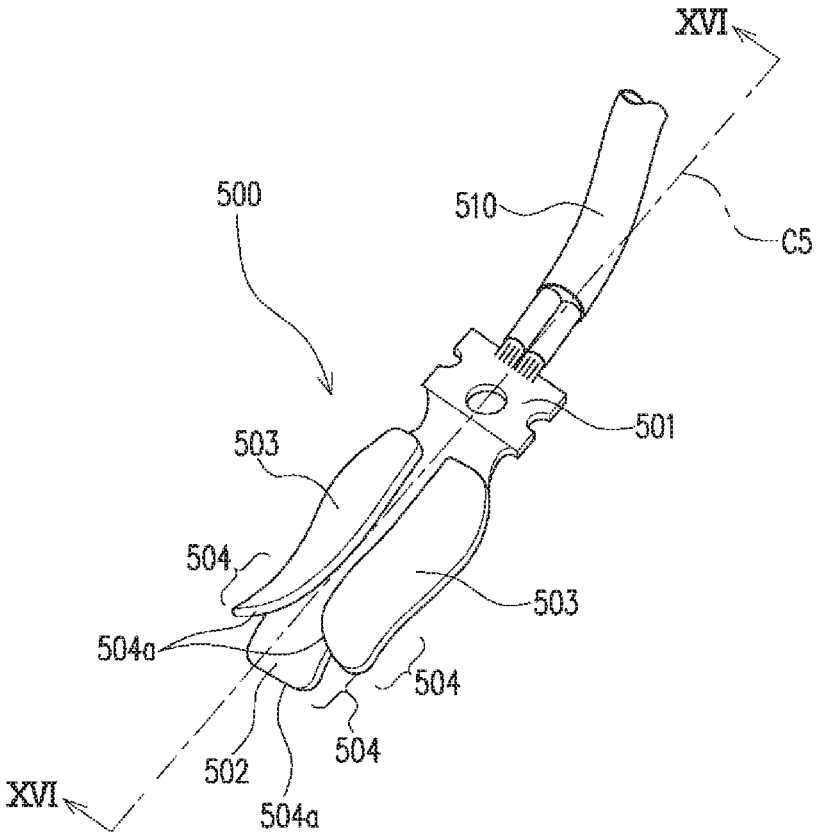
Fig. 15 (Prior Art)
FIG. 15 is a perspective view of a conventional connector terminal.
Figure 16:
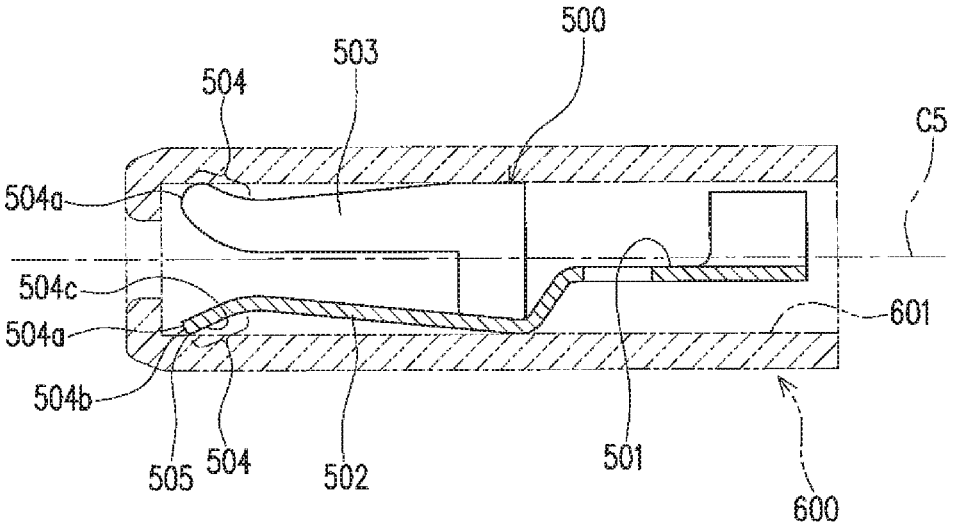
Fig. 16 (Prior Art)
FIG. 16 is a cross sectional view taken along line XVI-XVI in FIG. 15.

The aforementioned embodiment has been described by taking, for example, the case where the elastic contact piece 42 has the contact surface 4252 formed across the entire area in the width direction (i.e., a direction orthogonal to the direction in which the elastic contact piece 42 extends) of the distal end portion 425, without limitation thereto. As shown in FIG. 14, the connection surfaces 4252 can be formed at end portions in the width direction of the distal end 4251 of the elastic contact piece 42.

The aforementioned embodiment has been described by taking, for example, the case where the elastic contact pieces 42 of the connection terminal 2 include the connection surfaces 4252 having the same shape, without limitation thereto. The area in which the connection surface 4252 is formed, the angle of the connection surface 4252 relative to the outside surface 42B and/or the distal end surface 4251A, or the like can be different in each elastic contact piece 42.

The aforementioned embodiment has been described by taking, for example, the case where the connection surfaces 4252 of the elastic contact pieces 42 of the connector terminal 2 are formed by being chamfered, without limitation thereto. The connection surfaces 4252 can be initially formed, for example, at the time when the connector terminal member 2F is formed by casting or the like.

The aforementioned embodiment has been described by taking, for example, the case where, in the method for producing the connector terminal 2, the corners 4253 (see FIG. 10) of the distal ends 4251 of the elastic contact pieces 42 are collectively chamfered so that the connection surfaces 4252 of the elastic contact pieces 42 in the connector terminal member 2F (i.e., the flat plate-shaped connector terminal 2 before being subjected to the bending) are located on the same plane, without limitation thereto. The corners 4253 of the elastic contact pieces 42 can be chamfered individually.

The timing at which the chamfering step is performed is not limited. For example, the corners 4253 of the elastic contact pieces 42 can be chamfered after the tubular body 411 of the connector terminal member 2F is bent into a circular cylindrical shape.

The connector terminal, the connector, and the method for producing the connector terminal, of the present embodiment are as described above. However, the present invention is not limited thereto, and the design can be appropriately modified within the scope intended by the present invention. The operational advantage of the present invention is also not limited to the foregoing embodiments.

The embodiments disclosed herein should be construed in all respects as illustrative but not limiting. The scope of the present invention is not indicated by the foregoing description but by the scope of the claims. Further, the scope of the present invention is intended to include all the modifications equivalent in the sense and the scope to the scope of the claims

The invention claimed is:

1. A connector terminal, comprising:

a connection part into and from which a mating terminal pin is inserted and removed, wherein the connection part comprises a plurality of conductive pieces arranged at intervals from each other around a central axis extending along the insertion and removal direction of the mating terminal pin, wherein each of the plurality of conductive pieces has an inside surface that contacts the mating terminal pin during the insertion of the mating terminal pin into the connector terminal, and a plate shape that extends toward the removal direction of the mating terminal pin with the inside surface being directed to the central axis, wherein a distal end portion including a distal end of each of the conductive pieces is inclined to be away from the central axis as it advances toward the distal end thereof, wherein a surface of the distal end portion comprises: a distal end surface; an outside surface located opposite to the inside surface; and a connection surface connecting the distal end surface with the outside surface and inclined relative to the distal end surface and the outside surface, and wherein the connection surface is parallel or substantially parallel to the direction in which the central axis extends.

2. A connector, comprising:

the connector terminal according to claim 1; and a connector housing that communicates with the outside thereof through a terminal insertion port through which the mating terminal pin can be inserted and through a proximal end opening located opposite to the terminal insertion port, and that has a terminal housing part in which the connector terminal is housed with the distal end portion of each of the plurality of conductive pieces directed to the terminal insertion port, wherein the terminal housing part has a tubular inner surface extending toward the terminal insertion port, with the connection part enclosed therein.

3. A method for producing a connector terminal using a connector terminal member having a flat plate shape along a certain plane, the connector terminal member comprising: a tubular body elongated in a first direction that is a certain direction along the plane; and a plurality of conductive pieces that extend from the tubular body along a second direction orthogonal to the first direction and along the plane, and that are arranged at intervals from each other in the first direction, the method comprising:

a conductive piece bending step of bending the plurality of conductive pieces so that distal end portions including distal ends of the plurality of the conductive pieces are inclined in the same direction relative to the tubular body;

a chamfering step of chamfering a corner composed of a surface on one side in a thickness direction of the distal end portion of each of the plurality of conductive pieces in the connector terminal member, and a distal end surface of the distal end portion; and a tubular section forming step of, after the bending step and the chamfering step, bending the tubular body of the connector terminal member into a tubular shape with its edges in a longitudinal direction of the tubular body opposed to each other, so that the surface on the one side of each of the plurality of conductive pieces faces outward and that the distal end portion inclined in the conductive piece bending step is made to be away from a central axis of the tubular body as it advances toward an distal end of the connector terminal, wherein a connection surface is formed by the chamfering step, and wherein the connection surface is parallel or substantially parallel to a direction in which the central axis extends.

4. The method for producing the connector terminal according to claim 3, wherein the chamfering step is performed before the conductive piece bending step, and the chamfering step is performed to simultaneously chamfer the distal end portions of the plurality of conductive pieces so that the chamfered surfaces in the distal end portions of the plurality of conductive pieces are located on the same plane.

* * * * *